US005622288A

United States Patent [19]

Boring

[11] Patent Number: 5,622,288

[45] Date of Patent: Apr. 22, 1997

[54] CARTRIDGE PLUNGER WITH SURFACE CLEANING SKIRT

[75] Inventor: David E. Boring, East Berlin, Pa.

[73] Assignee: Sonoco Products Company, Hartsville, S.C.

[21] Appl. No.: 489,662

[22] Filed: Jun. 12, 1995

[51] Int. Cl.[6] ..... B65D 88/54

[52] U.S. Cl. ..... 222/327; 222/386

[58] Field of Search ..... 222/327, 386

[56] References Cited

U.S. PATENT DOCUMENTS

| | | |
|---|---|---|
| 2,855,130 | 10/1958 | Hosler . |
| 3,029,985 | 4/1962 | Krueger et al. . |
| 3,250,443 | 5/1966 | Abbott, Jr. . |
| 3,493,147 | 2/1970 | Ballin . |
| 3,501,063 | 3/1970 | Sundholm . |
| 3,870,200 | 3/1975 | Spatz . |
| 4,022,355 | 5/1977 | Sabaka . |
| 4,109,833 | 8/1978 | Gross . |
| 4,432,473 | 2/1984 | MacEwen . |
| 4,452,370 | 6/1984 | Langesiepen et al. . |
| 4,792,065 | 12/1988 | Soehnlein et al. . |
| 4,830,231 | 5/1989 | Smith . |
| 4,840,293 | 6/1989 | Segatz . |
| 4,854,485 | 8/1989 | Collins . |
| 4,869,403 | 9/1989 | Bruning . |
| 5,088,630 | 2/1992 | Arch et al. . |
| 5,242,091 | 9/1993 | Ishida et al. . |
| 5,316,186 | 5/1994 | Prestele . |
| 5,348,196 | 9/1994 | Smith et al. . |
| 5,400,926 | 3/1995 | Keller . |

FOREIGN PATENT DOCUMENTS

| | | |
|---|---|---|
| 0351441 | 1/1990 | European Pat. Off. . |

*Primary Examiner*—Gregory L. Huson

*Attorney, Agent, or Firm*—Dennison, Meserole, Pollack & Scheiner

[57] ABSTRACT

A cartridge tube and plunger wherein the skirt of the plunger includes a ridge pattern of a generally uniform compressibility with staggered areas of greater rigidity defined by intersecting ridges for intimate accommodation within interior surface irregularities on the cartridge tube.

15 Claims, 3 Drawing Sheets

FIG. 1
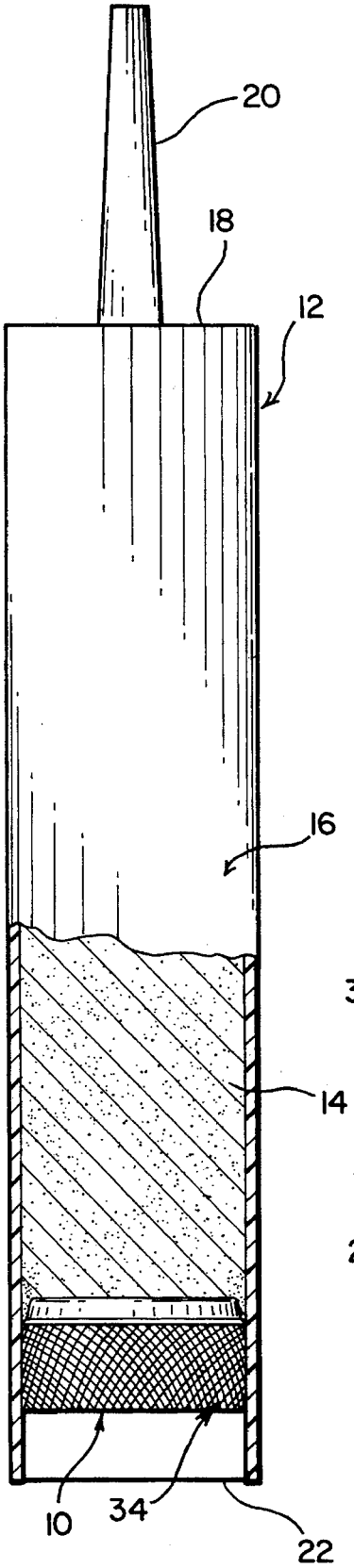
FIG. 2
(PRIOR ART)
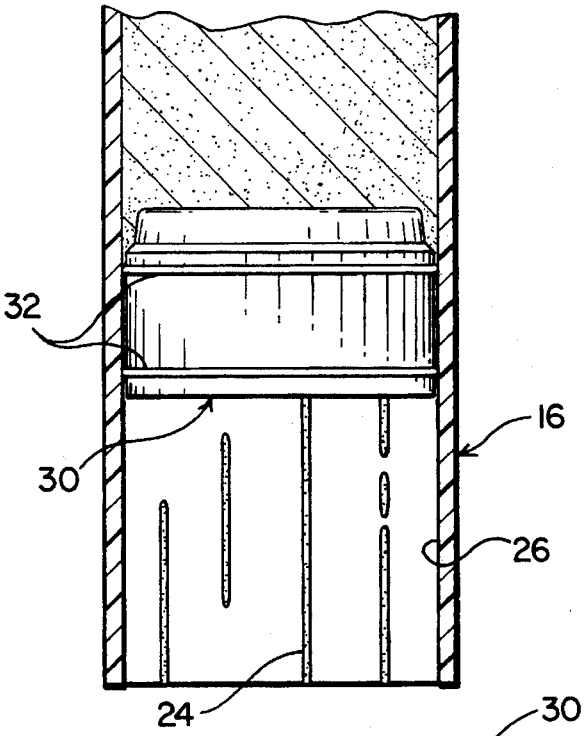
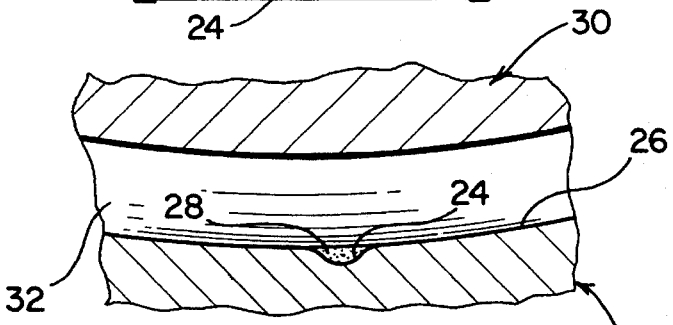
FIG. 3
(PRIOR ART)
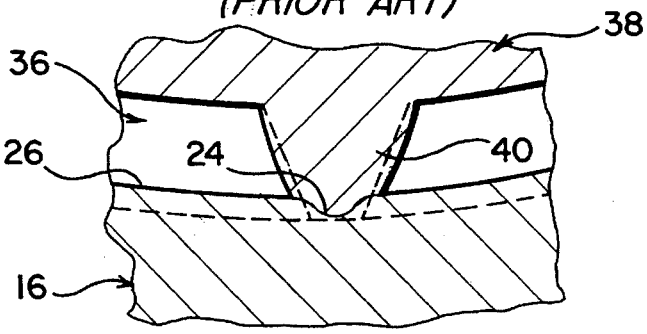
FIG. 4

CARTRIDGE PLUNGER WITH SURFACE CLEANING SKIRT

BACKGROUND OF THE INVENTION

Environmental concerns have made it desirable to decrease the residue remaining in emptied cartridges of the type used for the dispensing of paste-like products, for example caulking.

In order to successfully recycle plastics, particularly plastic containers, contaminants must be kept at a minimum. This is necessary for a variety of reasons including protection of the recycling equipment and maintaining the integrity of the recycled material. To this end, it is not uncommon for limits to be established for acceptable amounts of retained contents, above which plastic containers are not considered recyclable.

This is a particular problem with conventional caulk cartridges, normally made of an appropriate rigid plastic or synthetic resinous material for example polyethylene, in that such cartridges do not completely empty during regular usage. One facet of contents removal is the degree to which the plunger scrapes residue from the side wall or interior surface of the cartridge body. Failure to effectively scrape this surface could leave an unacceptable residue of the paste-like material.

In seeking an effective engagement between the plunger and the interior cartridge surface, reliance is normally placed on a tight fitting engagement of the plunger, and particularly the plunger skirt, with the tube surface, with the plunger having a slight degree of resilient flexibility. This engagement has, in some instances, been enhanced by the provision of circumferentially extending ribs projecting radially from the skirt surface.

However, at least in the case of vacuum calibrated extruded cartridge bodies, the interior surfaces are irregular on a minuscule scale. This is so as there is no mandrel to form the interior surface. Consequently, the interior surface is a free form version of the form that leaves the extrusion die. The accumulation of degraded polymer at the edge of the die causes small linear irregularities to be formed in the interior surface of the extrudate. These are diminished to a large extent during draw-down from the die to the calibration sleeve, and because of the natural tendency of the surface to level. However, the surface is never completely level and contains numerous very small linearly extending surface perturbations or irregularities. These normally interfere with sealing and dispensing effectiveness in that the smooth plunger wall cannot conform exactly to the irregular cartridge surface. The provision of annular ribs also does little to increase the effectiveness of the plunger, at least insofar as the linear irregularities which are usually in the nature of linearly extending grooves or depressions. Basically, the conventional ribs, of constant compressibility or rigidity, will tend to uniformly compress against the higher levels of the inner cartridge surface and span the minuscule linearly extending depressions or grooves. Thus, residue within the grooves is not effectively removed. Further, by failing to seat within the grooves, maximum sealing between the contents of the tube forward of the plunger, and the ambient air to the rear thereof, is not fully achieved. This, in turn may result in an undesirable tendency for the caulk to harden within the tube.

SUMMARY OF THE INVENTION

The plunger of the invention, preferably formed of an appropriate plastic or synthetic resinous material as used in the formation of conventional plungers, differs from the conventional plunger in being configured to specifically accommodate longitudinally extending minuscule grooves axially directed on the inner surface of the cartridge tube wall. Such grooves inherently result from the formation of the tube and can, in the normal cartridge and plunger construction, retain residue and preclude an effective peripheral sealing of the plunger to the surface.

In minimizing or eliminating these problems, the plunger of the invention is formed with multiple integral ridges peripherally about the outer surface of the plunger skirt. The ridges are of a uniform compressibility or rigidity with the arrangement thereof forming selected areas peripherally about the plunger skirt of greater rigidity and increased resistance to compression than the major portions of the ridges. So configured, as the ridges are compressed in light of the close tolerances between the plunger and the cartridge wall, the areas or points or greater rigidity tend to resist such compression and form what might be considered a series of higher pressure points. These areas or points, as they align with the axially extending grooves, tend to seat within and travel along the grooves, thus more effectively sealing to the cartridge surface and scraping residue therefrom. The enhanced sealing within these grooves will in turn provide for both improved product protection and improved shelf life of the cartridge.

The ridges of the invention, as opposed to the conventional annular ribs, are formed to intersect each other, for example by a crossing series of right hand and left hand spiral ridges about the exterior of the skirt which will provide a "waffle" pattern. The ridges are of the same configuration with the areas or points of increased rigidity being defined at the intersection points whereat the ridges inherently reinforce each other. By altering the ridge spacings and/or spiral angles, the intersection points will be staggered relative to each other in the axial direction of the plunger to avoid or minimize tracking of one high pressure area with another and provide multiple non-aligned high pressure points in contact with the wall of the cartridge. This substantially increases likelihood of engagement with a maximum number of the cartridge wall linear recesses.

As desired, the intersecting ridges may define other patterns which also extend continuously about the plunger skirt and form, at points of intersection, the areas or points of greater rigidity.

The ridges, in order to achieve a maximum scraping effect, include a forward face perpendicular to the surface of the skirt to provide a flat forward face with a sharp outer edge, in conjunction with an inclined following face. The spaces provided between the ridges will accommodate the scraped residue and accumulate the residue as the plunger travels toward the forward discharge end of the cartridge. As the forwardmost spaces tend to fill, the succeeding ridges and spaces will continue to remove and accumulate the residue.

Other features and advantages of the invention will become apparent from the more detailed disclosure hereinafter.

BRIEF DESCRIPTION OF THE DRAWINGS

FIG. 1 is an elevational view, partially in section, of a conventional caulk cartridge or the like with the plunger of the invention incorporated therein;

FIG. 2 is an enlarged cross-sectional view through a portion of a cartridge, the plunger mounted therein having typical prior art ribs thereon;

FIG. 3 is a further enlarged sectional detail through the plunger and cartridge of FIG. 2 illustrating the problem of retained residue unaffected by the conventional plunger;

FIG. 4 is a cross-sectional detail similar to FIG. 3 and illustrating the manner in which the plunger of the present invention provides for an enhanced removal of residue;

DESCRIPTION OF THE PREFERRED EMBODIMENTS

Figure 6:
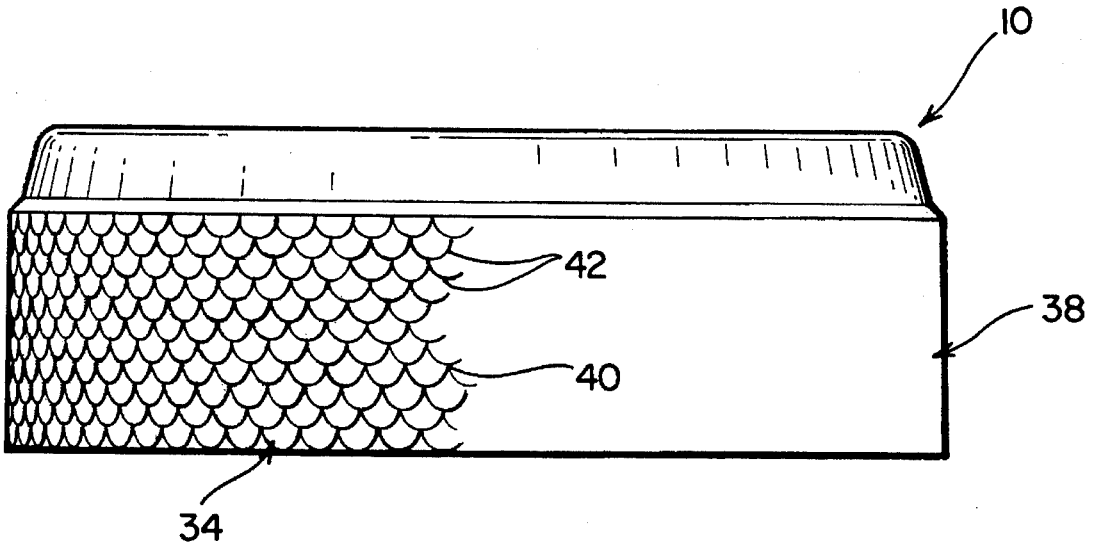
FIG. 6 is a similar elevation view with a second form of ridge layout or pattern schematically illustrated thereon.

The plunger 10 of the invention is illustrated in FIG. 1 in operative position within a conventional caulk cartridge 12. The cartridge 12, which can in fact accommodate any flowable paste-like dispensable material 14, includes a hollow cylindrical tube or body 16, a forward end 18 which normally mounts a dispensing nozzle 20, and a open rear end 22 with the plunger 10 positioned within the tube 16 immediately forward of the rear end 22. The plunger 10, in a conventional manner, is engaged and forwardly driven by the piston of a caulk gun or the like within which the cartridge is mounted.

FIGS. 2 and 3 are cross-sectional details which illustrate a typical prior art cartridge and plunger, and the inherent problems therein which are solved by the present invention. More specifically, the conventional plastic tube 16 is formed by a process which leaves minor irregularities, principally linearly extending elongate grooves or depressions 24, in the inner wall surface 26 thereof. These depressions, while quite shallow, do tend to accumulate content residue 28 which is normally not forwardly moved for discharge by the conventional plunger, herein designated by reference numeral 30. As such, a maximum cleaning of the interior of the tube 16, for recycling purposes, is not achieved. In addition, there is a less than perfect seal between the plunger and the interior surface 26 as could lead to an undesirable or premature curing of the caulk material 14 within the tube. In other words, in light of the elongate nature of the depressions or recesses 24, some or all of which may be of a length in the axial direction of the tube 16 to extend beyond both the leading and following ends of the plunger, any residue 28 exposed to ambient atmosphere behind the plunger following end, will commence curing with the curing action travelling along the residue path into the interior of the tubular body. While the curing rate will obviously be fairly slow, it could become significant in those situations in particular wherein the entire contents of the cartridge are not dispensed within a relatively short period of time.

Heretofore, in attempting to maximize the amount of paste-like material dispensed, many forms of plungers have been devised, including skirt walls with circumferential flexible ribs, as at 32. However, and noting FIG. 3 in particular, even the provision of circumferential or peripheral wiping ribs 32 does not effectively removed the residue accumulated within the groove or recess-type irregularities. Basically, the ribs 32 provide sequential non-intersecting bands of uniform compressibility/rigidity which uniformly flex in sealing engagement against the inner wall surface 26 and ride over or span the minute recesses 24 which are inherently quite narrow and irregularly spaced about the wall surface 26.

In order to better appreciate the significance of the invention, the details of construction of which shall be explained presently, attention is directed to the enlarged cross-section of FIG. 4 wherein the inner surface 26 of the tube 16 is provided with manufacturing irregularities, particularly the narrow longitudinally extending shallow grooves or depressions 24. However, and differing from the conventional plunger 30 of FIG. 3, the novel plunger 10 of the invention includes a ridge pattern or assembly 34 which, in addition to conforming closely to the interior surface 26, is capable of accommodating itself to, and projecting into, the recesses 24 as the plunger moves axially along the length of the tube. In this manner, there is a substantially closer seal with the tube surface 14, and a significantly more effective cleaning or removal of the residue.

More particularly, the ridge assembly 34, comprising a series of ridges 36 integrally molded with and to the outer surface of the plunger skirt 38 peripherally thereabout, is so configured as to provide multiple points or small areas 40 of greater rigidity than the remainder of the ridge assembly. These points of greater rigidity are, along the length of the plunger skirt 38 in the axial or linear direction of movement of the plunger 10 within the tube 16, laterally or peripherally slightly offset from each other so as to not track along the same path as the plunger moves forwardly. Rather, these comparatively more rigid points move along adjacent parallel paths and will, because of the large number of such points provided, engage in most if not all of the longitudinal depressions 24 to achieve the desired cleaning and sealing of the depressions.

Figure 5:
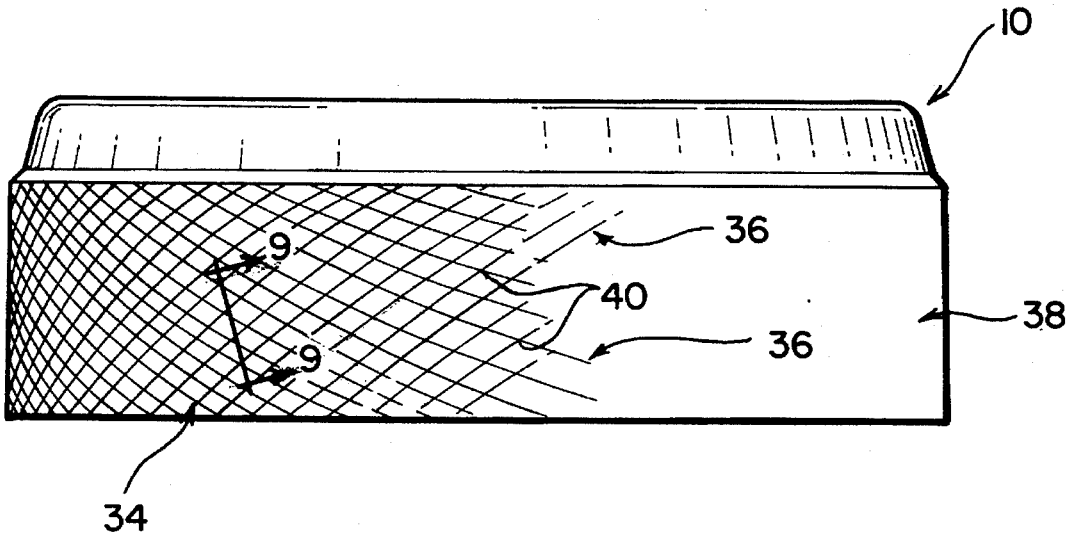
FIG. 5 is an enlarged side elevational view of the plunger of the invention with one proposed ridge layout or arrangement schematically illustrated thereon.
Figure 7:
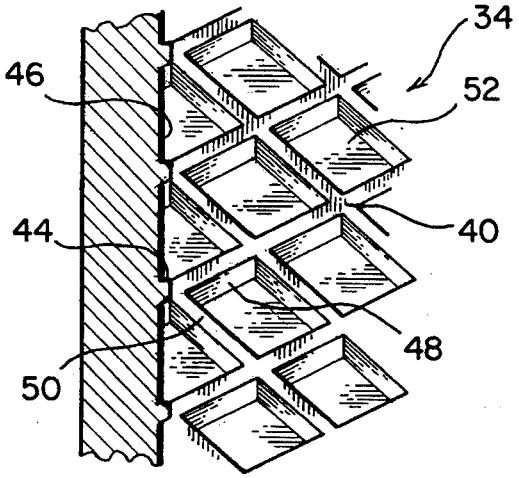
FIG. 7 is a perspective detail of the ridge layout of FIG. 5 and illustrates the ridge intersections defining the points of greater rigidity.

The ridges 36 are preferably of uniform compressibility/rigidity and are arranged in an assembly or pattern wherein the ridges intersect. A basic pattern of intersecting ridges 36 is illustrated in FIGS. 5 and 7, and includes two oppositely spiraling series of ridges crossing each other in a "waffle" or grid pattern. It is the intersecting of the ridges 36 whereat the points or areas 40 of greater rigidity are inherently formed by the bulk and mutual stability provided by the intersecting ridges.

The intersection points 40 will be staggered relative to each other in the axial direction of movement of the plunger 10, with the staggered relationship determined by specific ridge spacings and/or the spiral angles at which the ridges 36 extend. As these points are of an inherent greater rigidity, and require a corresponding higher pressure for compression than the single length portions of the ridges, these points, when aligned with the longitudinal depressions 24, will not automatically compress with the adjacent linear extent of the ridges to each side of the depression 24. Rather, the points 40, in light of the greater rigidity thereof, will remain substantially uncompressed, and will extend into or bottom in corresponding aligned depressions 24, as suggested in FIG. 4, selectively compressing only upon encountering the positive resistance of the rigid surfaces defining the depressions.

It will of course be appreciated that the additional rigidity of the intersection points or areas 40, or the greater pressure required to compress such areas, will not interfere with the intimate engagement of the ridge assembly with the inner surface 26 of the cartridge 12 between the staggered depressions 24. Basically, these points 40, in the absence of expansion room as provided by the recesses or grooves 24, will compress with the ridge assembly as a whole to provide a clean sweeping action. It is only when these points 40 align with a depression, that the points 40 are not compressed and extend into the depressions.

Figure 8:
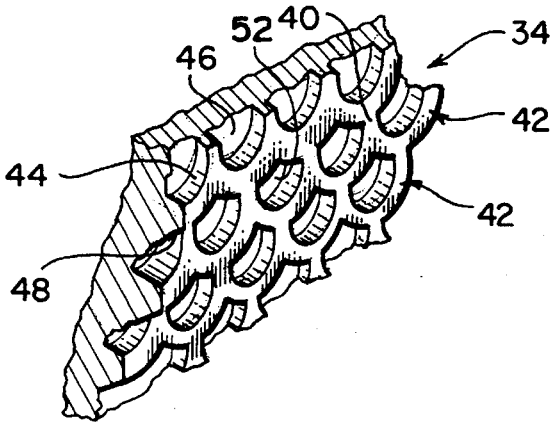
FIG. 8 is a similar perspective detail of the ridge layout of FIG. 6.

The ridge assembly 34 of intersecting ridges can define other patterns, note as one example the "scallop" design of FIGS. 6 and 8 wherein axial staggered arcuate shaped ridges 42 are provided circumferentially about the plunger. As with the spiral ridges 36, the points of intersection of the ridges 42 form the points or areas of greater stiffness or rigidity for engagement within any tube depression with which they might align during axial travel of the plunger in the tube.

Figure 9:
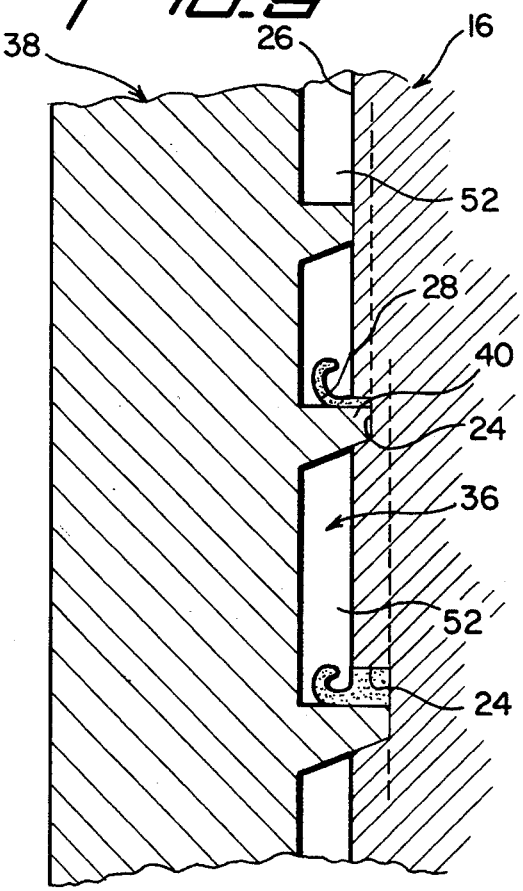
FIG. 9 is an enlarged cross-sectional detail on line 9—9 in FIG. 5 illustrating the manner in which the points or areas of greater rigidity accommodate themselves to linearly extending deformations, recesses or grooves inherently formed within the inner surface of the cartridge body for a complete cleaning of the-residue therefrom.
Figure 10:
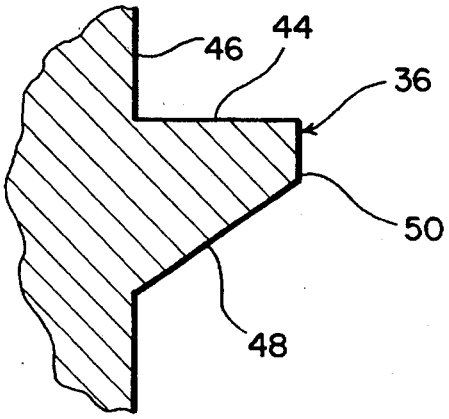
FIG. 10 is an enlarged cross-sectional detail through a single ridge.

In order to achieve maximum effectiveness, the ridges, noting FIGS. 9 and 10 and regardless of the pattern of the ridge assembly, are of uniform or substantially uniform cross-section and include a planar leading face 44 perpendicular to the skirt surface 46, an inclined trailing face 48, and a narrow flat outer or apex edge 50. The leading faces 44, directed forwardly along the path of travel of the plunger 10, provide a positive scraping action along the inner surface of the tube, both with the smoother portions thereof and along the depressions 24. The reside scraped from the inner surface of the tube is collected within the chambers or spaces 52 provided immediately following each ridge. This has been suggested in FIG. 9. These chambers 52 are wider than the thickness of the ridges, and may be as much as ten times wider to effectively accommodate the residue. As the forwardmost defined chambers become filled with the scraped residue, the following chambers sequentially accommodate the additional residue, thus providing for a continuing collection of the residue throughout the full extent of the plunger.

With continued reference to FIG. 9, as this section is taken on a line intersecting the staggered points or areas 40 of greater stiffness or rigidity, the various points are illustrated as engaging circumferentially spaced portions of the tube wall. For example, the uppermost point or ridge area, which is actually illustrated as a ridge cross-section, is shown as engaging the inner wall surface 26 in the absence of any aligned depression 24. As such, this uppermost ridge point area is under substantial compression as suggested by the short and thick profile illustrated.

The middle ridge area or point engages within a shallow groove 24 which, as illustrated by the phantom lines thereabove, extends for a length along the tube wall. The ridge area engaged within this depression is compressed to a lesser degree than the uppermost ridge area.

The lowermost ridge area is engaged within a relatively deeper groove which, as also illustrated in phantom lines, may extend longitudinally for a distance along the path of travel of the lowermost ridge area. In view of the relatively deeper nature of the lowermost depression 24, the corresponding lowermost ridge area is substantially uncompressed in that no compressing resistance is encountered until such time as this area contacts the surface or surfaces defining the recess.

The straight leading or "plow" type face 44 on the ridges tends to effectively remove the cartridge contents and residue, while the following inclined face 48 tends to stabilize the leading face and the configuration of the residue receiving chambers to avoid a slippage of the plunger past the residue.

The foregoing described embodiments are illustrative of the features of the invention. As other embodiments incorporating the inventive features may occur to those skilled in the art, the disclosed embodiments are not to be considered as a limitation on the scope of the invention.

What is claimed is:

1. In a dispensing cartridge for paste-like material, an elongate tubular body having a hollow interior for containing the paste-like material, a forward discharge end and a following end, said tubular body having an inner surface defining said hollow interior, an outlet at said discharge end for selective discharge of contained material therethrough, a planter receivable within and axially slidable along said interior for selective forward movement toward said discharge end for engagement with and forward discharge of contained material through said outlet, said plunger including a peripheral skirt movable along said body inner surface in adjacent relation thereto peripherally about said interior; the improvement comprising resiliently compressible ridge means on said plunger skirt projecting outward therefrom peripherally about said plunger, said ridge means being intimately engageable with said inner surface and being flexibly resilient to provide a wiping action against said inner surface, selected portions of said ridge means, at peripherally and axially spaced areas about said skirt, being of a greater rigidity than the remainder of said ridge means for accommodation within depressions as may occur in the interior surface, axially adjacent ones of said selected portions being peripherally offset from each other.

2. The improvement of claim 1 wherein said ridge means comprises multiple ridges arranged in a pattern of intersecting ridges forming intersections which define said selected portions of greater rigidity.

3. The improvement of claim 2 wherein said ridges are arranged in two series of parallel ridges crossing each other in a grid pattern completely encircling said skirt.

4. The improvement of claim 2 wherein said ridges form a series of shapes with each shape intersecting an adjacent shape and defining one of said intersections therewith.

5. The improvement of claim 2 wherein said pattern of intersecting ridges extend over at least a major portion of said skirt.

6. The improvement of claim 5 wherein each ridge has a planar leading face projecting perpendicular to said plunger skirt, an outer edge, and a trailing face at an obtuse angle to said plunger skirt and diverging from said leading face.

7. The improvement of claim 6 wherein said ridges are arranged in two series of generally parallel ridges crossing each other in a grid pattern completely-encircling said skirt.

8. The improvement of claim 6 wherein said ridges form a series of shapes with each shape intersecting an adjacent shape and defining one of said intersections.

9. In a dispensing cartridge for paste-like material, an elongate tubular body having a hollow interior for containing the paste-like material, a forward discharge end and a following end, said tubular body having an inner surface defining said hollow interior, an outlet at said discharge end for selective discharge of contained material therethrough, a plunger receivable within and axially slidable along said interior for selective forward movement toward said discharge end for engagement with and forward discharge of contained material through said outlet, said plunger including a peripheral skirt movable along said body inner surface in adjacent relation thereto peripherally about said interior;

the improvement comprising resiliently compressible ridge means on said plunger skirt projecting outward therefrom peripherally about said plunger, said ridge means being intimately engageable with said inner surface and being flexibly resilient to provide a wiping action against said inner surface, selected portions of said ridge means, at peripherally and axially spaced areas about said skirt, being of a greater rigidity than the remainder of said ridge means for accommodation within depressions as may occur in the interior surface, said ridge means comprising multiple ridges arranged in a pattern of intersecting ridges forming intersections which define said selected portions of greater rigidity.

10. A plunger adapted for the enhanced cleaning of irregularities in the internal wall surfaces of dispensing cartridges for paste-like materials; said plunger comprising a plunger skirt of predetermined length and periphery, wall surface engaging means on and projecting outward of said skirt completely about said skirt, said wall surface engaging means being of a substantially uniform resilient compressibility and including peripherally spaced small areas of a lesser degree of compressibility relative to the major portion of said wall surface engaging means, said small areas being spaced along the length of the plunger skirt with adjacent ones of said small areas along the length being peripherally offset from each other.

11. A plunger adapted for the enhanced cleaning of irregularities in the internal wall surfaces of a dispensing cartridge for paste-like materials; said plunger comprising a plunger skirt of predetermined length and periphery, wall surface engaging means on and projecting outward of said skirt completely about said skirt, said wall surface engaging means being of a substantially uniform resilient compressibility and including spaced small areas of a lesser degree of compressibility relative to the major portion of said wall surface engaging means, said small areas being spaced along both the length of the skirt and about the periphery thereof, said wall surface engaging means comprising multiple ridges arranged in a pattern of intersecting ridges forming intersections which define said selected areas of lesser compressibility.

12. The improvement of claim 11 wherein said ridges are arranged in two series of generally parallel ridges crossing each other in a grid pattern completely encircling said skirt.

13. The improvement of claim 11 wherein said ridges form a series of shapes with each shape intersecting an adjacent shape and defining one of said intersections.

14. The improvement of claim 11 wherein said pattern of intersecting ridges extend over at least a major portion of said skirt.

15. The improvement of claim 14 wherein each ridge has a planar leading face projecting perpendicular to said plunger skirt, an outer edge, and a trailing face at an obtuse angle to said plunger skirt and diverging from said leading face.

* * * * *

UNITED STATES PATENT AND TRADEMARK OFFICE

CERTIFICATE OF CORRECTION

PATENT NO. : 5,622,288
DATED : April 22, 1997
INVENTOR(S) : Boring, David E.

It is certified that error appears in the above-indentified patent and that said Letters Patent is hereby corrected as shown below:

In column 6, line 16, "planter" should read --plunger--.

Signed and Sealed this

Twenty-fourth Day of June, 1997

Bruce Lehman

*Attest:*

BRUCE LEHMAN

*Attesting Officer*

*Commissioner of Patents and Trademarks*